US007367482B1

(12) United States Patent
Witherspoon, Jr.

(10) Patent No.: US 7,367,482 B1
(45) **Date of Patent: *May 6, 2008**

(54) SECURABLE GAME BALL STORAGE BAG

(76) Inventor: Frank Witherspoon, Jr., 9093 Plume Grass St., Corona, CA (US) 92883

( * ) Notice: Subject to any disclaimer, the term of this patent is extended or adjusted under 35 U.S.C. 154(b) by 540 days.

This patent is subject to a terminal disclaimer.

(21) Appl. No.: 10/932,548

(22) Filed: Sep. 2, 2004

Related U.S. Application Data

(60) Provisional application No. 60/499,878, filed on Sep. 2, 2003.

(51) Int. Cl.
*A45C 15/00* (2006.01)

(52) U.S. Cl. ..... 224/576; 224/584; 224/614; 206/1.5; 206/315.9

(58) Field of Classification Search ..... 224/576, 224/614, 584; 190/101, 120; 150/102; 70/18, 70/68, 277, 278.1, 278.7
See application file for complete search history.

(56) References Cited

U.S. PATENT DOCUMENTS 1,680,652 A * 8/1928 Walinsky ..... 70/68
2,254,578 A * 9/1941 O'Brien ..... 190/107
4,031,724 A * 6/1977 Atkinson ..... 70/68
4,213,314 A * 7/1980 Trader ..... 70/68
4,988,987 A * 1/1991 Barrett et al. ..... 340/5.28
5,153,561 A * 10/1992 Johnson ..... 340/571
5,560,135 A * 10/1996 Ciluffo ..... 42/70.07
5,638,707 A * 6/1997 Gould ..... 70/56
5,668,929 A * 9/1997 Foster, Jr. ..... 704/273
6,161,959 A * 12/2000 Abraham ..... 383/97
6,472,973 B1 * 10/2002 Harold et al. ..... 340/5.73
6,726,071 B2 * 4/2004 Baseflug et al. ..... 224/258
7,007,804 B1 * 3/2006 Witherspoon, Jr. ..... 206/579
2003/0151510 A1 * 8/2003 Quintana et al. ..... 340/568.2
2004/0022455 A1 * 2/2004 Reason ..... 383/5

* cited by examiner

*Primary Examiner*—Nathan J. Newhouse
*Assistant Examiner*—Jack Morgan
(74) *Attorney, Agent, or Firm*—Kenneth L Tolar

(57) ABSTRACT

A securable game ball storage bag includes a bag member having a hollow interior for reception of a game ball and various accessory items such as a wallet and keys. The interior is accessible with a zipper having a pull tab with a latch adjacent thereto. A shoulder strap includes a first end permanently secured to the bag exterior and a free second end. The free end includes a buckle insert that is secured within an appropriate slot on a lock housing by a spring-biased, solenoid driven pin. The zipper tab and latch member are likewise secured within receptacles on the lock housing. The pins are moved out of locking engagement with the buckle insert by entering a predetermined code into a keypad; the pins are released from the zipper tab and latch by speaking a predetermined verbal command into a microphone.

6 Claims, 1 Drawing Sheet

SECURABLE GAME BALL STORAGE BAG

CROSS REFERENCE TO RELATED APPLICATIONS

This application is entitled to the benefit of provisional application No. 60/499,878 filed on Sep. 2, 2003.

BACKGROUND OF THE INVENTION

1. Technical Field of the Invention

The present invention relates to game ball storage bag including a locking means for securing the contents thereof.

2. Description of the Prior Art

Basketball players and other similar athletes often transport their own balls to and from a gym or playing surface. Because the player usually transports valuables such as keys, cell phones, wallets and other items, such items must be stored while the player participates in a game. However, leaving such items unattended can result in theft or tampering. Accordingly, there is currently a need for a device that secures both a game ball and valuables therein. The present invention provides a uniquely designed game ball bag having a voice and keypad activated locking means that provides selective access to the bag interior.

SUMMARY OF THE INVENTION

The present invention relates to a securable game ball storage bag comprising a hollow bag member generally configured and dimensioned to accommodate a game ball such as a basketball, a soccer ball, a football, etc. The bag member includes a separable seam on an upper portion thereof that is opened and closed with an elongated zipper. The zipper includes a pull tab having an aperture thereon. The bag member also includes a shoulder strap having two opposing ends. A first end is permanently secured to the bag member exterior using a D-ring or similar conventional fastener. A second end of the strap is free and includes a buckle insert attached thereto. Fastened to the bag member, adjacent an end of the elongated zipper, is a latch having an aperture formed thereon. The latch is positioned such that it is adjacent the zipper tab when the zipper is closed.

The device also comprises a locking mechanism including a housing having an upper surface, a lower surface, two opposing ends and a pair of opposing side edges. At a first end of the housing is a slot for reception of the strap buckle insert. At the opposing end of the housing are a pair of receptacles for receiving the zipper tab and latch member respectively. Disposed within the housing interior is an electronic locking mechanism including a microprocessor that controls solenoid operated, spring-biased locking pins; each pin extends and retracts into and out of the apertures on the latch, zipper tab and shoulder strap buckle insert to releasably secure such items to the lock housing. The locking pin that secures the strap buckle insert includes a separate driver from that associated with the zipper tab and latch locking pins. On the upper surface of the housing is a removable faceplate having a plurality of numeric keys thereon. The numeric keys are in communication with the microprocessor and allow the user to enter a preprogrammed pass code to selectively operate the buckle insert locking pin driver. The microprocessor also includes voice recognition software that operates the zipper tab and latch pin drivers. Accordingly, a speaker and microphone are provided on the removable faceplate into which a user speaks a predetermined command in order to activate the respective drivers.

To use the above described device, a user inserts a game ball and/or valuables into the bag member interior. The zipper is closed by sliding the zipper tab toward an end of the zipper. The shoulder strap is wrapped about a supporting surface such as a fence or post and the buckle insert is placed into its respective slot on the locking mechanism housing. If desired, the faceplate may be removed prior to closure of the zipper to secure the faceplate within the bag interior thereby preventing those who may have expropriated the pass code from releasing the strap and removing the bag. Both the zipper tab and the latch are then inserted into their respective receptacles on the housing thereby securing the bag to the supporting surface. To access the contents of the bag, an authorized user verbalizes the predetermined command into the speaker on the lock housing. The microprocessor and appropriate drivers raise the pins to release the zipper tab and strap latch from their receptacles allowing the contents of the bag to be accessed.

It is therefore an object of the present invention to provide a game ball storage bag having a locking means for securing valuables therein.

It is another object of the present invention to provide a game ball storage bag having a voice activated locking means that can only be manipulated by authorized users.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
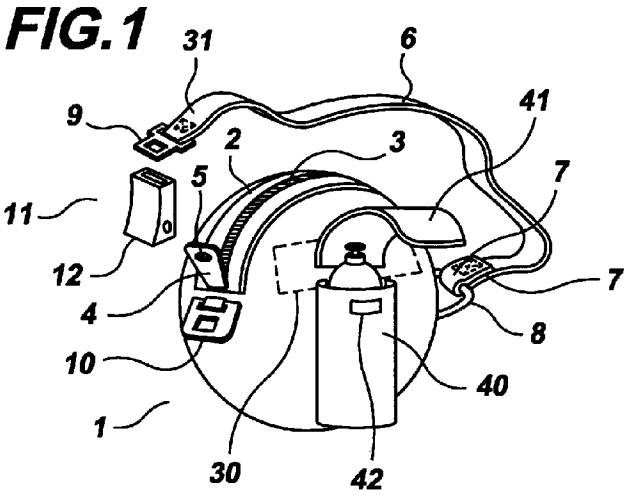
FIG. 1 is a perspective view of the game ball storage bag according to the present invention.
Figure 2:
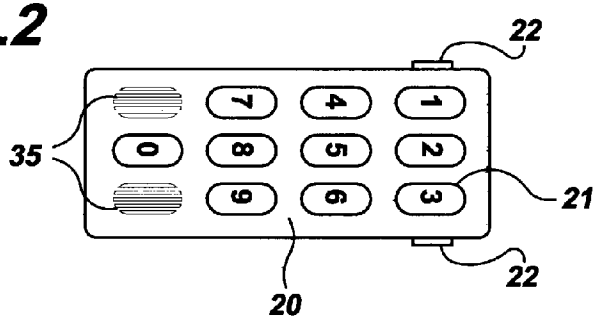
FIG. 2 is a top view of the locking mechanism housing.
Figure 3:
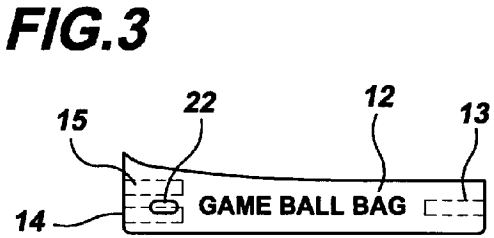
FIG. 3 is a side view of the locking mechanism housing.
Figure 4:
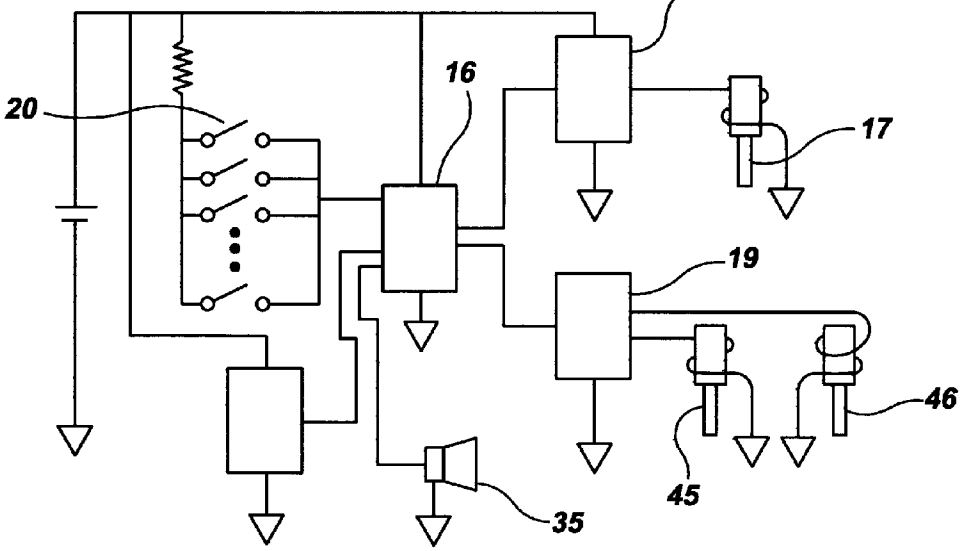
FIG. 4 is a circuit diagram of the locking mechanism electronics.

The present invention relates to a securable game ball storage bag comprising a hollow bag member 1 generally configured and dimensioned to accommodate a game ball such as a basketball, a soccer ball, a football, etc. The bag member includes a separable seam 2 on an upper portion thereof that is opened and closed with an elongated zipper 3. The zipper includes a pull tab 4 having an aperture 5 thereon. Within the bag interior is preferably an accessory pocket 30 for storing valuables such as wallets, cell phones, keys, etc.

On the exterior surface of the bag member is a sleeve 40 for slidably receiving beverage containers or similar items. A flap 41 is positioned above the opening having a fastener thereon for mating engagement with a similar fastener 42 on the sleeve exterior.

The bag member also includes a shoulder strap 6 having two opposing ends. A first end 7 is permanently secured to the bag member exterior using a D-ring 8 or similar conventional fastener. A second end 31 of the strap is free and includes a buckle insert 9 attached thereto. Fastened to the bag member, adjacent an end of the elongated zipper, is a latch 10 having an aperture formed thereon. The latch is positioned such that it is adjacent the zipper tab when the zipper is closed as depicted in FIG. 1.

The device also comprises a locking mechanism 11 including a housing 12 having an upper surface, a lower surface, two opposing ends and a pair of opposing side edges. At a first end of the housing is a slot 13 for reception of the strap buckle insert. At the opposing end of the housing are a pair of receptacles 14, 15 for receiving the zipper tab and latch member respectively. Disposed within the housing interior is an electronic locking mechanism including a microprocessor 16 that controls solenoid operated, spring-biased locking pins. When either the buckle insert, latch or zipper tab is inserted into its respective slot or receptacle, the spring biased pin automatically seats within the aperture to lock such item within the housing. When a designated pin driver is activated, the pin is retracted thereby releasing such items. The locking pin 17 that secures the strap buckle insert includes a separate driver 18 from that 19 associated with the zipper tab 45 and latch 46 locking pins.

On the upper surface of the housing is a faceplate 20 having a plurality of numeric keys 21 thereon. Each of two side edges of the faceplate includes a depressible button 22 that releases the faceplate from the housing allowing it to be securely stored within the bag interior if desired. The numeric keys are in communication with the microprocessor and allow the user to enter a preprogrammed pass code to selectively operate the buckle insert locking pin driver. The microprocessor also includes voice recognition software that operates the zipper tab and latch pin drivers. Accordingly, a speaker 35 and microphone are provided on the removable faceplate into which a user speaks a predetermined command in order to activate the respective drivers.

To use the above described device, a user inserts a game ball and/or valuables into the bag member interior. The zipper is closed by sliding the zipper tab toward an end of the zipper. The shoulder strap is wrapped about a supporting surface such as a fence or post and the buckle insert is placed into its respective slot on the locking mechanism housing. If desired, the faceplate may be removed prior to closure of the zipper to secure the faceplate within the bag interior thereby preventing those who may have expropriated the pass code from releasing the strap and removing the bag. Both the zipper tab and the latch are then inserted into their respective receptacles on the housing thereby securing the bag to the supporting surface. To access the contents of the bag, an authorized user verbalizes the predetermined command into the speaker on the lock housing. The microprocessor and appropriate drivers raise the pins to release the zipper tab and latch from their receptacles allowing the contents of the bag to be accessed. If the user wishes to merely release the bag from the supporting surface, he or she enters the appropriate pass code into the keypad thereby raising the designated locking pins to release the buckle insert from the lock housing slot.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A securable game ball storage bag comprising:

a hollow bag member having an exterior surface and a hollow interior for reception of a game ball and accessory items;

a shoulder strap having first and second ends, said first end fastened to said bag, said second end being free;

a zipper positioned on the exterior surface of said bag member, said zipper movable between open and closed positions providing selective access to said bag interior, said zipper including a pull tab;

a buckle insert positioned on the free end of said shoulder strap;

a housing having a slot thereon for reception of said buckle insert;

an electronically operated locking pin positioned within said slot for locking engagement with said buckle insert;

a latch positioned on the exterior surface of said bag member, adjacent said zipper;

a pair of receptacles on said housing, each of said receptacles having an electronically-operated locking pin received therein for locking engagement with either of said latch and said zipper tab, one of said receptacles receiving said latch and the other of said receptacles receiving said zipper tab.

2. The bag according to claim 1 further comprising a release means for disengaging said locking pins from said buckle insert, said latch member and said zipper tab.

3. The storage bag according to claim 2 wherein said release means includes a keypad in communication with a microprocessor and the locking pin positioned within said slot whereby entering a predetermined numeric code into said keypad releases said locking pin.

4. The storage bag according to claim 3 wherein said release means includes a voice recognition means for recognizing a predetermined voice command, said voice recognition means in communication with a microprocessor and the locking pins received within said receptacles whereby speaking the predetermined verbal command releases the locking pins from locking engagement with said latch member and said zipper tab.

5. The bag according to claim 3 wherein said keypad is removably attached to said housing allowing said keypad to be stored within the bag interior.

6. The bag according to claim 1 further comprising an accessory pocket positioned within the bag interior for receiving accessory items.

* * * * *